United States Patent [19]

Syring

[11] Patent Number: 4,510,729

[45] Date of Patent: Apr. 16, 1985

[54] METHOD AND TEMPLATE FOR APPLYING RELIEF PLASTERING ON A WALL SURFACE

[76] Inventor: Ewald Syring, Brinker Weg 4a, D-5620 Velbert-Langenberg, Fed. Rep. of Germany

[21] Appl. No.: 483,075

[22] Filed: Apr. 7, 1983

[30] Foreign Application Priority Data

Sep. 17, 1982 [DE] Fed. Rep. of Germany ..... 3234481
Oct. 27, 1982 [DE] Fed. Rep. of Germany ..... 3239761

[51] Int. Cl.[3] ..... E04F 21/04
[52] U.S. Cl. ..... 52/741; 52/311; 52/315; 427/282
[58] Field of Search ..... 52/741, 311, 314, 315; 264/24; 427/264, 282

[56] References Cited

U.S. PATENT DOCUMENTS

| | | | |
|---|---|---|---|
| 1,110,335 | 3/1913 | Kritzer | 101/29 |
| 2,095,641 | 10/1937 | Knight . | |
| 3,096,195 | 7/1963 | Seman . | |
| 3,496,694 | 2/1970 | Hicks et al. | 52/314 X |
| 3,712,825 | 1/1973 | Yocum | 52/741 X |
| 3,991,529 | 11/1976 | Terwilliger | 52/314 X |
| 4,307,552 | 12/1981 | Votte | 52/741 X |

FOREIGN PATENT DOCUMENTS

| | | | |
|---|---|---|---|
| 666026 | 7/1963 | Canada | 52/314 |
| 2332263 | 1/1974 | Fed. Rep. of Germany . | |
| 7530244 | 1/1977 | Fed. Rep. of Germany . | |
| 7906888 | 6/1979 | Fed. Rep. of Germany . | |
| 3234481 | 3/1984 | Fed. Rep. of Germany . | |

OTHER PUBLICATIONS

"Look What's Happened to Brick" Popular Mechancis Wayne Leckey, Oct. 1957, pp. 180–185.

*Primary Examiner*—J. Karl Bell
*Attorney, Agent, or Firm*—Lee, Smith & Zickert

[57] ABSTRACT

It is the object of the invention to give also the non-professional the possibility to apply, by means of this method and a template, mineral plaster in the form of clinker plastering to a wall surface. To this end a template with a network corresponding to joints and made of impregnated cardboard is applied to a continuous carrier film by means of a non-hardening adhesive, and is folded in zig-zag form. The network is removed from the carrier film and stuck to the same extent to a wall surface. Afterwards the mineral plaster is applied to the wall surface. After removing the network a clinker or brick-work like structure is attained. In the spray rendering method embodiment the network is made of paper-thin, tension-resistant material. The network and carrier film are then rolled up in a roll.

17 Claims, 11 Drawing Figures

METHOD AND TEMPLATE FOR APPLYING RELIEF PLASTERING ON A WALL SURFACE

CROSS-REFERENCES TO RELATED APPLICATIONS

This application is co-pending with West German Patent applications P 32 34 481.3-25, filed Sept. 17, 1982; and P 32 39 761.5, filed Oct. 27, 1982, the disclosures of which are incorporated herein by reference thereto.

BACKGROUND AND SUMMARY OF THE INVENTION

The invention relates to a method for applying relief plastering with joints on a wall or floor surface, wherein (a) a network of lands made of a moisture-resistant material and corresponding to the structure of the joints is applied to the surface by means of a removable adhesive layer, apertures being defined between these lands, (b) subsequently mineral plaster is applied to the surface which is provided with the network, and (c) next the network is pulled off the surface, so that in the areas of the apertures projecting surface portions and in the areas of the lands receding, joint-like surface portions are obtained.

Such a method is, for example, suitable for applying relief plastering to an outdoor or indoor wall, or floor surface, which then shows the texture of a brick or stone formation. For that reason it is possible to give a concrete surface the appearance of brick-work, without having to face the concrete surface expensively with clinker.

The network of the template, which imitates the joints of brick-work, is applied to the surface by the adhesive layer. Then the surface is plastered and the plaster fills the apertures. After the plaster has dried and the network has been removed, a texture that looks like a brick formation, is attained.

With known prior art methods, the template comprises nothing but a network of self-adhesive lands with free apertures therebetween, wherein the self-adhesive rear surfaces of the lands are covered by plastic strips or the like. Such a network is difficult to handle. Only rather small templates are used, quite a number of which has to be placed side by side.

Another template is known from German utility model No. 75 30 244. The application of this prior art template to the wall is also complicated.

It is the object of the invention to make, in a method of the present type, the application of the template to the surface and the handling of the template, easier.

A further object of the invention is to provide a method of the present type wherein the attained relief-plastering looks as similar as possible to genuine brick-work or clinker.

It is a more specific object of the invention to enable also a non-professional to apply plaster in clinker-shape to a concrete surface.

A still further object of the invention is to make a clinker-like relief plastering using conventional mineral plaster.

According to the invention (d) the template adheres by means of a removable adhesive layer to a width of continuous carrier film that covers also the apertures, (e) to apply the template to the concrete surface, the carrier film is yanked off on one end from the template and this end is stuck to the surface, (f) the carrier film is then yanked off further to the same extent as the template is pressed on to the surface.

Further details of the method of the invention and the templates used therewith are explained in the following description and are characterized in the claims.

Embodiments of the invention are described hereinbelow in greater detail with reference to the accompanying drawings.

DETAILED DESCRIPTION OF THE INVENTION

The methods and apparatus of the invention are described below with a wall as the surface to which the template pattern is applied. It should be understood, however, that such type of surface is only exemplary and is not to be taken as a restriction on the practice of the invention.

The template 10 for applying a brick-like relief-plastering to a wall surface has an arrangement of apertures 12 in a network 14 of lands defining the apertures 12 and made of moisture-resistant material, e.g. impregnated paperboard, the thickness of which is equal to the desired joint depth.

The lands are provided with a removable layer of a non-hardening adhesive, which is covered by a plastics film. Here this film of plastic, is a continuous carrier film 16 which covers also the apertures 12.

Figure 1:
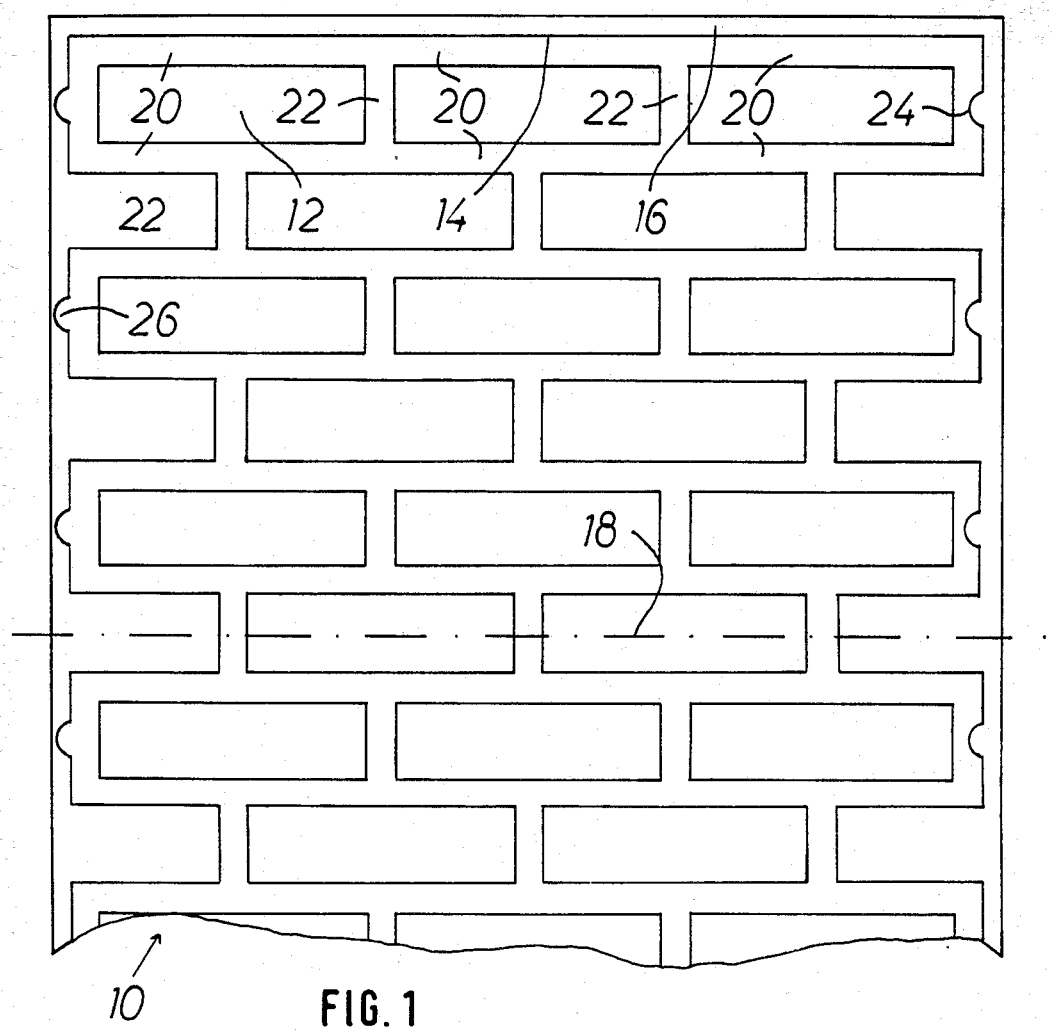
FIG. 1 shows a partial front view of a template, for carrying out the method of the invention, in an unrolled state.
Figure 2:
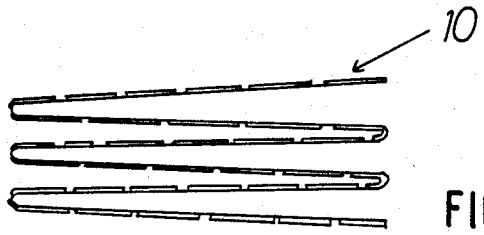
FIG. 2 shows a side-view of the template in a folded state.

As can be seen from FIG. 2, the network 14 adheres to the carrier film 16 and is folded in its initial state along the folding lines 18 (FIG. 1) in a zig-zag form. In this way, the template 10 with the carrier film 16 is easy to handle. For application of the network to the wall the carrier film 16 is yanked off at one end of the template and this end of the network is stuck up to the wall. Then the carrier film 16 is yanked off downwards to the same extent as the network 14 and the adhesive layer is pressed onto the wall surface.

The network 14 has spaced and parallel transverse lands 20, which extend transversely across the carrier film 16. The transverse lands 20 are interconnected by spaced and parallel longitudinal lands 22. The longitudinal lands 22 of a row are staggered relative to those of the next row. In that way elongate apertures 12, are attained in this embodiment, which look like the structure of brick-work.

As can be seen from FIG. 1, the network 14 has lateral recesses 24 on one side (on the right in FIG. 1) and projections complementary thereto on the other side (on the left in FIG. 1). The recesses and projections facilitate the alignment of adjacent templates 10. When one template has been applied to the wall the other can be aligned with the first, by fitting in the projections 26 of one template into the recesses 24 of the other, or vice versa.

In the embodiment described above the template consists of lands of a material, such as impregnated cardboard, the thickness of which corresponds to the joint-depth. This material is rather inflexible and cannot be rolled up. Because the material is relatively thick it must not overlap when applied to a wall. Therefore, it is necessary to apply adjacent widths to the wall in such a way, that not only the lands are in true alignment, but also the widths of templates are flush. Some special measures are therefore taken:

The embodiment described hereinbelow permits further simplification of the handling of the template. This is achieved by making the network of lands of a material which is tension resistant, thin as paper and flexible.

The network with the carrier film can be rolled up in a roll in its initial state.

A method for applying clinker-plastering to a wall surface by means of a template of the present type is characterized by the steps:

(a) removing an edge portion of the network from the carrier film and fastening it to the wall surface by means of the adhesive layer;

(b) removing the network from the carrier film so that the carrier film is unrolled from the roll to the same extent as the network is removed the carrier film and is progressively fastened to the wall surface;

(c) applying mineral plaster as spray rendering of a plurality of layers to the wall surface which is provided with the network; and (d) removing the network from the wall surface with this part of the plaster which adheres to the lands, after the lowermost layer has dried but as long as the uppermost layer has not yet hardened.

Such a network of a paper-thin layer can be rolled up together with the carrier film and therefore is easier to handle. There is no need to apply the widths of network in a flush manner to the wall surface, as it does no harm if the edges of the widths overlap insignificantly. After applying the plaster, the network of lands with the plaster adhering to it can be pulled off leaving a texture of joints. Surprisingly, it has turned out that, for this joint formation no thickness of the lands adapted to the relief-depth is required.

The dried lowermost layer of the material applied to the lands stiffens them sufficiently so that they can be pulled off with this material, without pulling along the material in the area of the apertures. That is only possible if the plaster is spray rendering. The application of spray rendering, however, requires appropriate equipment and therefore in practice is worthwhile only with large areas.

Figure 3:
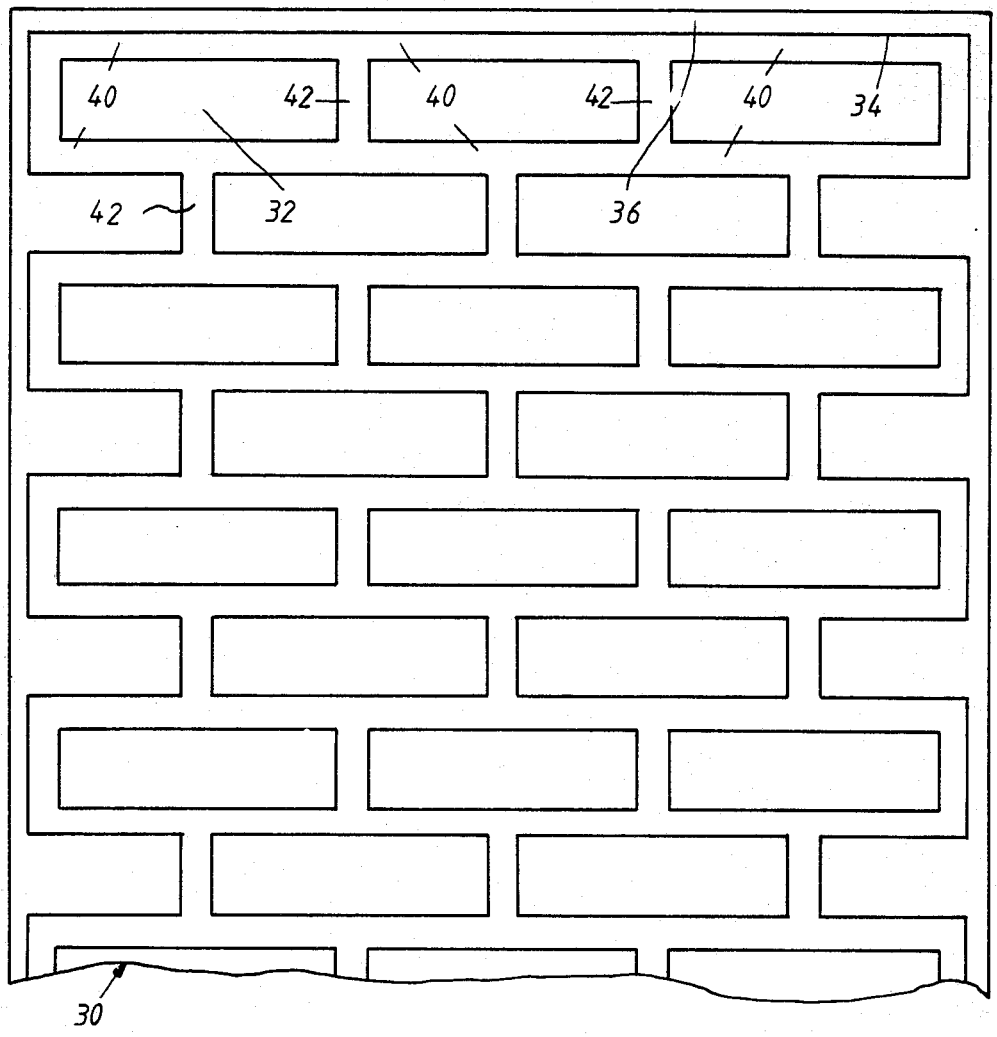
FIG. 3 shows a partial front-view of another embodiment of a template for carrying out the method of the invention.

In FIG. 3, the template 30 for applying a brick-like relief plastering to a wall surface has an arrangement of apertures 32 in a network 34, the apertures 32 are defined by lands made of a moisture-resistant, tension resistant, thin as paper and flexible material, e.g. an impregnated, tension resistant paper.

The lands are provided with a removable, adhesive layer of a non-hardening adhesive, which is covered by a stripable carrier film extending also over the apertures 12. The network 34 has spaced and parallel transverse lands 40 which extend transversely across the carrier film 36. The transvers lands 40 are interconnected by spaced and parallel longitudinal lands 52. The longitudinal lands 52 of one row are staggered relative to the adjacent row. In that manner, elongate apertures 32 are defined in this embodiment, to look like the structure of brick-work.

Figure 4:
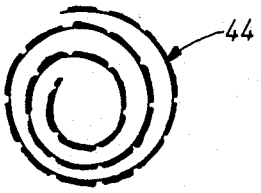
FIG. 4 shows the template in rolled up state.

As can be seen from FIG. 4 the network 30 with the carrier film 36 is rolled up in a roll 44 in its initial state.

FIGS. 5 to 11, show schematically the various steps of a method for applying a brick-work-like relief plastering to a wall surface by means of a template 30 of the type described above.

Figure 5:
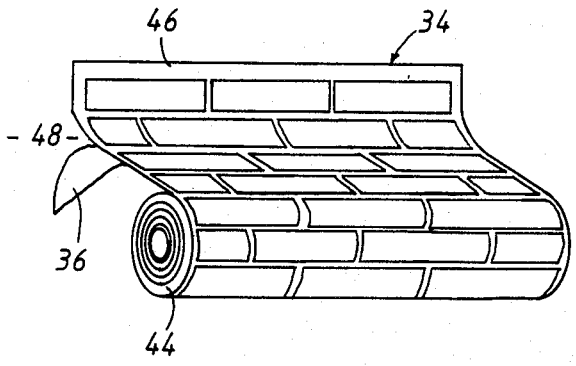
FIGS. 5 to 11 show schematically the steps of making a relief plastering on a wall surface by means of a template as shown in FIGS. 3 and 4.
Figure 6:
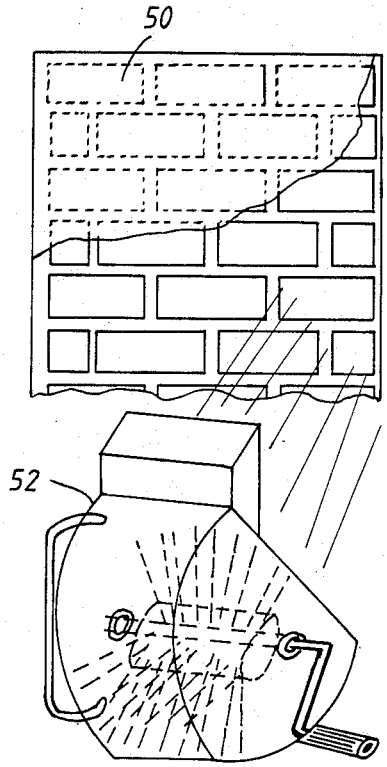

First, an edge portion 46 of the network 34 is removed from the carrier film 36. This edge portion 46 is affixed to a wall surface 48 by means of the adhesive layer at the upper end of the area to which the relief-plastering is to be applied. This is illustrated in FIG. 5. Then, the network is removed from the carrier film 36 in such a manner that the carrier film 36 is unrolled from the roll 44 to the same extent as the network 34 is removed from the carrier film 36 and is progressively affixed to the wall surface 48. It is possible to apply several widths of network 34 like wall paper widths, side by side to the wall surface. Of course, the transverse lands must be in true alignment. However, it is not necessary to apply the widths edge to edge, or flush. It does no harm if the widths overlap insignificantly.

Then the plaster 50 is applied to the wall surface 48 provided with the network 34. The plaster 50 is applied by means of a known, and not further described, appliance 52 as a so called "spray rendering". This is illustrated schematically in FIG. 6.

Usually spray rendering is sprayed on the wall in three layers, the respective lower layer drying before the next one is applied. The lowermost layer of spray rendering applied in the areas of the lands is slightly offset to the front relative to the layer applied in the areas of the apertures. After the layers have dried, those portions of the lowermost layer which adhere to the lands are connected only incoherently or not at all with the portions of the lowermost layer which are applied directly to the background in the areas of the apertures. After a second and a third layer have been applied, a thickness of plaster is achieved which is substantially equal to the joint depth.

Figure 7:
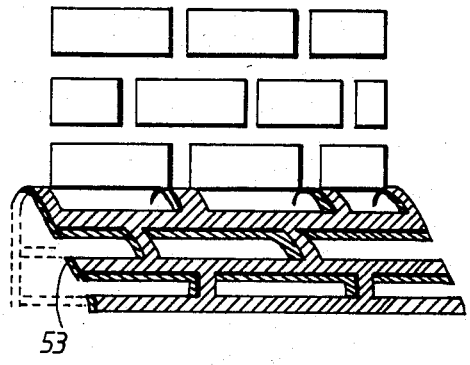

Finally, the network 34, with portion 53 of the plaster 50 which adheres to the lands 40,42 is pulled off from the wall surface, as shown in FIG. 7. The paper-thin material of the network 34 with the spray rendering applied in three layers, forms a structure that is stiff enough to allow pulling off the network.

By applying the plaster in the form of spray rendering, the binding between the plaster adhering to the lands 50,52 and the plaster adhering to the wall surface 48 itself in the apertures 32, is relatively weak. For that reason it is possible to pull off the network 34 with the plaster adhering to it, without damaging the portions of plaster 50 which correspond to the apertures 42. A plastering which has the structure of brick work is thus obtained.

Figure 8:
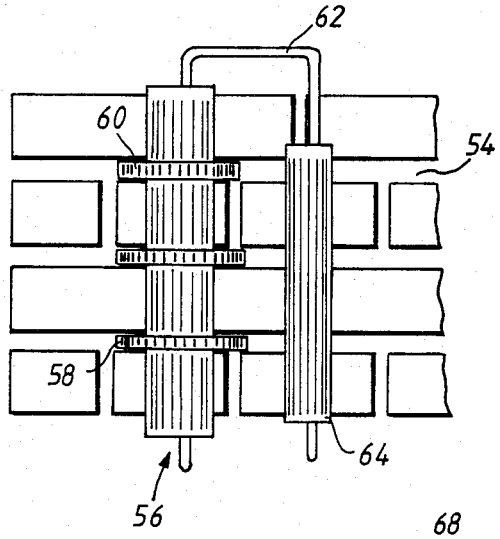
Figure 9:
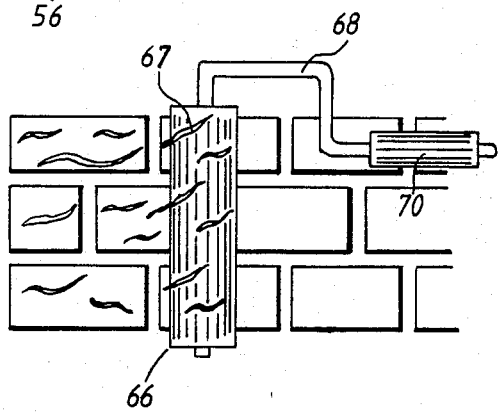

When there is no first coating or if unevenness must be adjusted, it is advantageous with both kinds of relief plastering to apply to the wall a first coating which is colored in the wanted joint color before applying the network to obtain the wall surface 48. If there is a first coating, the wall surface is first cleaned. Afterwards an adhesive layer which is colored in the desired joint color is applied with a conventional paint roller. The described template is applied to the wall after the wall surface has dried. After the application of the network 34 a colored plaster having the desired color of the clinker is applied in the described manner to the first coating. As shown in FIG. 8, joint edges 54 which may project after pulling off the network 34, as shown in FIG. 7, are leveled out by means of a joint roller 56. The joint roller 56 has a generally cylindrical roller body and is guided along the joints by means of one or more projecting circumferential ridges 60, of which height and width are substantially equal to the depth and width respectively of the obtained joints. The roller body 58 is mounted, like a standard paint-roller, rotatably on the leg of yoke 62. The other leg carries a rotatable handle 64.

For attaining a relief-plastering surface structure similar to clinker or brickwork, a texture-roller 66 (FIG. 9) which has erratic projecting portions 67 is moved over the surface after application of the plaster. The projecting portions are thus pressed into the still soft plaster. An irregular surface texture similar to genuine clinker is attained. This is shown schematically in FIG. 9. The texture-roller 66 is mounted rotatably, similar to a paint-roller, on one leg of the yoke 68. The other leg of the yoke 68 again carries a rotatable handle 70.

Figure 10:
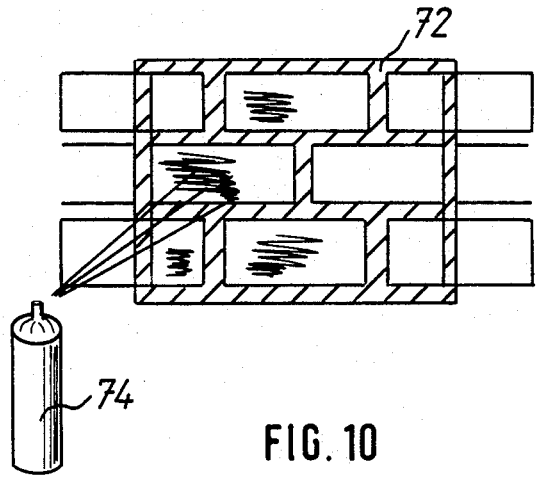
Figure 11:
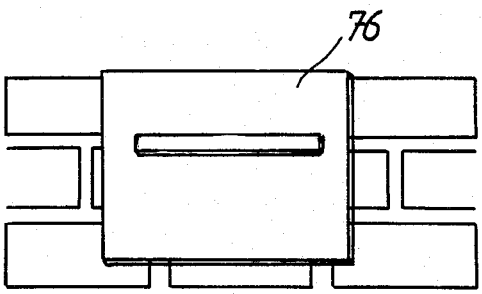

Often the color of genuine, natural clinker varies across the surface. To imitate this effect, a paint mask 72, for attaining extra color effects, is placed over the attained joints after pulling off the network 34. The surface texture is powdered with paint powder by means of an atomizer. The applied colored powder is mingled on the surface with the non-hardened plaster by moving a plastering trowel 76 across the surface texture. That is shown in FIGS. 10 and 11.

Other relief structures, e.g. tile-textures can be attained in similar way.

Although the invention has been described above with a certain degree of particularity, it should be understood that this disclosure has been made only by way of example. Consequently, numerous changes in the details of the method and apparatus of the invention may be apparent to those familiar with the art, and may be resorted to without departing from the scope of the invention as claimed.

I claim:

1. Method for applying relief plastering with joints on a surface, wherein (a) a network of lands made of a moisture-resistant material and corresponding to the structure of the joints is applied to the surface by means of a removable adhesive layer, the lands, when applied, defining a series of apertures spaced by the lands, (b) subsequently, mineral plaster is applied to the surface which is provided with the network, and (c) next, the network is pulled off the surface so that in the areas of the apertures projecting surface portions, and in the areas of the lands receding, joint-like surface portions are obtained, characterized in that, (d) the network of lands is formed into a continuous template which adheres by means of an adhesive layer to a width of continuous, removable carrier film that also covers the apertures, (e) to apply the template to the surface, the carrier film is removed at one end from the template and this end is applied to the surface, (f) the carrier film is then further removed to the same extent as the template is pressed onto the surface.

2. Method as claimed in claim 1 characterized in that, before the network is applied, a colored first coating, in compliance with the desired joint color, is applied to the surface.

3. Method as claimed in claim 1 characterized in that, after the network has been applied, a colored plaster is applied to the first coating.

4. Method as claimed in claim 1 characterized in that, after removing the network from the surface, projecting joint edges are leveled out by means of a joint-roller with a roller body, which is moved along the joints by means of one or more circumferential ridges of which height and width are substantially equal to the depth and width, respectively, of the attained joints.

5. Method as claimed in claim 1 characterized in that a texture-roller with erratic projecting portions is moved across the surface after the plaster has been applied, and the projecting portions are pressed into the plaster, which is still soft, so that an irregular surface similar to clinker is attained.

6. Method as claimed in claim 1 characterized in that, in order to attain special color effects after removing the network (a) a paint mask is placed over the attained joints and (b) the remaining surface is powdered with paint powder by an atomizer.

7. Method as claimed in claim 1 characterized in that the applied paint is mingled on the surface with the still non-hardened plaster, by moving a plastering trowel across the surface.

8. Method for applying relief plastering with joints on a surface, wherein (a) a network of lands made of a moisture-resistant material and corresponding to the structure of the joints is applied to the surface by means of a removable adhesive layer, the lands, when applied, defining a series of apertures spaced by the lands, (b) subsequently, mineral plaster is applied to the surface which is provided with the network, and (c) next the network is pulled off the surface, so that in the areas of the apertures, projecting surface portions, and in the areas of the lands receding, joint-like surface portions are obtained, characterized by the steps, that (d) the network of lands is formed into a continuous template which adheres by means of an adhesive layer to a width of continuous, removable carrier film that also covers the apertures, (e) to apply the template to the wall surface, the carrier film is removed at one end from the template and this end is applied to the surface, (f) the carrier film is then further removed to the same extent as the template is pressed onto the wall surface, (g) the network is removed from the surface and projecting joint edges are levelled out by means of a joint-roller with a roller body, which is moved along the joints by means of one or more circumferential ridges, of which height and width are substantially equal to the depth and width, respectively, of the attained joints, and (h) a texture-roller with erratic projecting portions is moved across the surface after the plaster has been applied, and the projecting portions are pressed into the plaster while still soft, so that an irregular surface similar to genuine brick is attained.

9. Method as claimed in claim 8 characterized in that, in order to attain special color effects after the removal of the network, (h) a paint mask is placed over the attained joints, (i) the remaining surface is powdered with paint-powder by an atomizer, and (k) the applied paint is mingled on the surface with the still non-hardened plaster by moving a plastering trowel across the surface.

10. A template for applying a relief-plastering to a surface, which template has an arrangement of apertures in a network, the apertures being defined by interconnected lands made of a moisture-resistant material of which the thickness is substantially equal to the depth of the relief, the lands being provided with an adhesive layer which is covered by a removable plastics layer, said plastics layer being formed of a continuous carrier film also covering the apertures.

11. Template as claimed in claim 10 characterized in that the carrier film with the network adhering to it is folded in zig-zag form.

12. Template as claimed in claim 10 characterized in that the network has spaced and parallel transverse lands which extend transversely across the carrier film and are interconnected by rows of spaced and parallel lands.

13. Template as claimed in claim 10 characterized in that the network has longitudinal lands of one row staggered relative to an adjacent row of longitudinal lands.

14. Template as claimed in claim 10 characterized in that the network has lateral recesses on one side and projections complementary thereto on the other side.

15. Template as claimed in claim 10 characterized in that the network of lands is made of a tension-resistant, paper-thin, flexible material.

16. Template as claimed in claim 15 characterized in that the network and the carrier film are rolled up together in a roll, in their initial state.

17. Method for the application of a relief-plastering to a surface by means of a template as claimed in claim 16 characterized by the steps of (a) removing an edge portion of the network from the carrier film and fastening it to the surface by means of the adhesive layer, (b) removing the network from the carrier film, so that the carrier film is unrolled from the roll to the same extent as the network is removed from the carrier film and is progressively fastened to the surface, (c) applying mineral plaster as spray rendering of a plurality of layers to the surface which is provided with the network, and (d) removing the network from the surface with the part of the plaster which adheres to the lands, after the lowermost layer has been dried but as long as the uppermost layer has not yet hardened.

* * * * *